US005078629A

United States Patent [19]

Mondek

[11] Patent Number: 5,078,629

[45] Date of Patent: * Jan. 7, 1992

[54] PIVOTAL AIR INDUCTION FOR MARINE PROPULSION UNIT

[75] Inventor: Martin J. Mondek, Wonder Lake, Ill.

[73] Assignee: Outboard Marine Corporation, Waukegan, Ill.

[ * ] Notice: The portion of the term of this patent subsequent to Nov. 18, 2003 has been disclaimed.

[21] Appl. No.: 649,163

[22] Filed: Feb. 1, 1991

Related U.S. Application Data

[63] Continuation of Ser. No. 631,408, Jul. 16, 1984, abandoned.

[51] Int. Cl.[5] ..... B63H 21/36

[52] U.S. Cl. ..... 440/88; 123/195 C

[58] Field of Search ..... 440/112, 88, 53-65, 440/76, 77, 49, 900; 123/195 C, 195 E; 285/189, 223, 292; 180/3, 63

[56] References Cited

U.S. PATENT DOCUMENTS

| | | | |
|---|---|---|---|
| 1,846,283 | 2/1932 | Summers | 180/68.3 |
| 1,863,015 | 6/1932 | Kamrath | 180/68.3 |
| 2,216,496 | 10/1940 | MacKay | 440/112 |
| 2,494,158 | 1/1950 | Below | 440/112 |
| 2,952,327 | 9/1960 | Farr | 180/68.3 |
| 3,136,285 | 6/1964 | Kiekhaefer | 440/57 |
| 3,151,695 | 10/1964 | Mintz | 180/68.3 |
| 3,181,495 | 5/1965 | Kiekhaefer | 440/57 |
| 3,250,501 | 5/1966 | Alexander | 440/76 |
| 3,487,804 | 1/1970 | Kiekhaefer | 440/76 |
| 4,080,184 | 3/1978 | Peterson | 180/68.3 |
| 4,289,488 | 9/1981 | Weroniue | 440/57 |
| 4,395,238 | 7/1983 | Payne | 440/53 |
| 4,416,475 | 11/1983 | Stacy | 285/272 |
| 4,623,313 | 11/1986 | Ferguson | 440/77 |
| 4,753,619 | 6/1988 | Sullivan | 440/88 |

FOREIGN PATENT DOCUMENTS

| | | | |
|---|---|---|---|
| 722419 | 11/1965 | Canada | 440/88 |
| 1026729 | 10/1950 | France | 440/88 |
| 2079706 | 1/1982 | United Kingdom | 440/112 |
| 2083787 | 3/1982 | United Kingdom | 440/112 |
| 2084097 | 4/1982 | United Kingdom | 440/53 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

A marine propulsion device comprising a propulsion unit including an internal combustion engine, a shroud substantially enclosing the engine, and a duct having a first and communicating with the shroud and an opposite second end being adapted for connection to an opening in the transom of a boat to enable lthe engine to draw combustion air from the interior of the boat, the duct including a flexible portion and a rigid portion.

9 Claims, 4 Drawing Sheets

PIVOTAL AIR INDUCTION FOR MARINE PROPULSION UNIT

This is a continuation of U.S. patent application Ser. No. 631,408, filed July 16, 1984, now abandoned.

BACKGROUND OF THE INVENTION

Outboard motors are designed to minimize the likelihood of taking water into the engine during rain or high sea conditions. Typically the engine shrouds are designed to provide such protection. Large outboard motors are likely to be used on large boats designed for offshore operation where sea conditions can be severe. It is not desirable to operate such boats with standard or conventional high (20 inch) transoms which can allow a following sea to enter the boat. Therefore, such boats typically mount an outboard on a bracket behind an extra high transom. In order to provide combustion air for the engine, such outboards have sometimes been provided with a flexible air supply hose or duct connected between the engine shroud and the transom and extending through the transom to supply air from the cockpit of the boat. As a result, tilting and turning of the motor involves flexure of the duct which adds to the tilting and steering effort.

Attention is directed to the following U.S. patents:

Stevens U.S. Pat. No. 4,375,356, issued Mar. 1, 1983;

Blanchard U.S. Pat. No. 4,371,348, issued Feb. 1, 1983; and

Payne U.S. Pat. No. 4,395,238, issued July 26, 1983.

SUMMARY OF THE INVENTION

The invention provides a marine propulsion device comprising a propulsion unit including an internal combustion engine, a shroud substantially enclosing the engine, and duct means having a first end communicating with the shroud and an opposite second end being adapted for connection to an opening in the transom of a boat to enable the engine to draw combustion air from the interior of the boat, the duct means including a flexible portion and a rigid portion.

The invention also provides an outboard motor comprising an engine including a power head and a lower propulsion unit, a cover assembly for the engine including a lower pan-like cover and an upper dome-like cover enclosing the power head, a combustion air opening in the cover assembly, rigid duct means rotatably connected to the cover assembly at the opening, and flexible duct means having a first end connected to the rigid duct means and a second end adapted for connection to an opening in the transom of a boat to enable the engine to draw combustion air from the interior of the boat.

The invention also provides a marine propulsion device comprising a propulsion unit including an internal combustion engine, a shroud substantially enclosing the engine and including therein a combustion air opening, rigid duct means opening upwardly into the interior of the shroud and being rotatably connected to the shroud for rotation about a generally vertical axis, and flexible duct means having a first end connected to the rigid duct means and a second end adapted for connection to an opening in the transom of a boat to enable the engine to draw combustion air from the interior of the boat.

The invention also provides a marine propulsion device comprising a mounting bracket assembly, a propulsion unit including an internal combustion engine and rotatably connected to the mounting bracket assembly for rotation relative to the mounting bracket assembly about a generally vertical steering axis, a shroud substantially enclosing the engine and including therein a combustion air opening generally co-axial with the steering axis, and duct means opening downwardly through the shroud into the interior thereof at the opening and being rotatably connected to the shroud for rotation about the steering axis, the duct means being adapted for connection to an opening in the transom of a boat to enable the engine to draw combustion air from the interior of the boat.

The invention also provides a marine propulsion device comprising a mounting bracket assembly adapted to be mounted on a boat transom for pivotal movement relative to the boat transom about a generally horizontal tilt axis, a propulsion unit including an internal combustion engine and being connected to the mounting bracket assembly for common pivotal movement with the mounting bracket assembly about the tilt axis, a shroud substantially enclosing the engine and including therein a combustion air opening, flexible duct means including a turret rotatably connected to the shroud at the opening, rigid duct means adapted for connection to an opening in the transom of the boat to enable the engine to draw combustion air from the interior of the boat, and means interconnecting the flexible duct means and the rigid duct means for relative rotation therebetween about the tilt axis.

The invention also provides a marine propulsion device comprising a mounting bracket assembly adapted to be mounted on a boat transom for pivotal movement relative to the boat transom about a generally horizontal tilt axis, a propulsion unit including an internal combustion engine and being connected to the mounting bracket assembly for common pivotal movement with the mounting bracket assembly about a tilt axis, a shroud substantially enclosing the engine and including therein a combustion air opening, flexible duct means connected to the combustion air opening, rigid duct means adapted for connection to an opening in the transom of the boat to enable the engine to draw combustion air from the interior of the boat, and means interconnecting the flexible duct means and the rigid duct means for relative rotation therebetween about the tilt axis.

The invention also provides a marine vehicle comprising a boat including a transom having an opening therein, a propulsion unit including an internal combustion engine and being mounted on the transom, a shroud substantially enclosing the engine, and duct means having a first end communicating with the shroud and an opposite second end communicating with the opening in the transom, the duct means including a flexible portion and a rigid portion.

This invention is not limited to the details of construction and the arrangement of components set forth in the following description or illustrated in the drawings. The invention is capable of other embodiments and of being practiced and carried out in various ways. Also it is to be understood that the phraseology and terminology employed herein is for the purpose of description and should not be regarded as limiting.

DETAILED DESCRIPTION OF THE DRAWINGS

Figure 1:
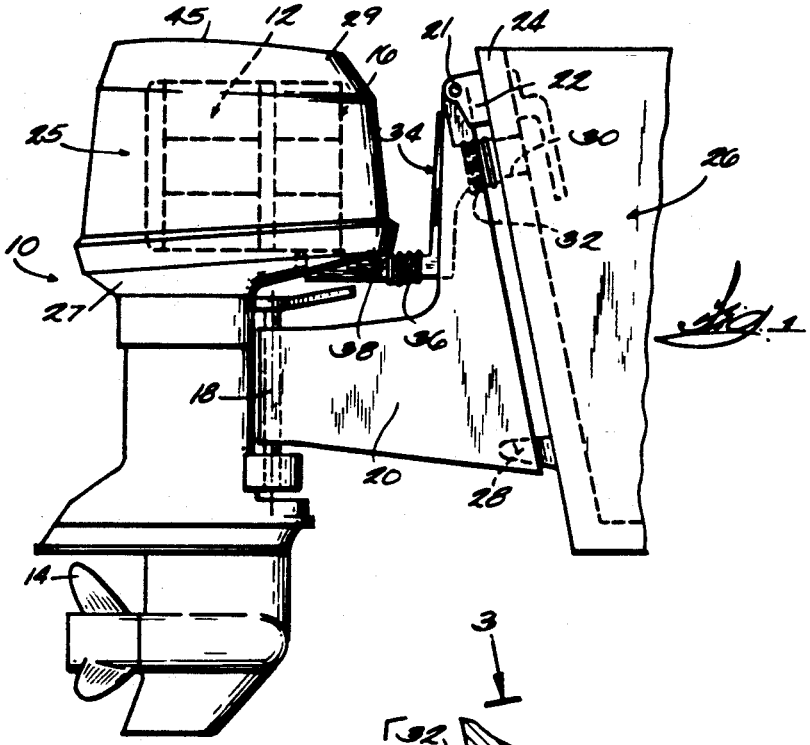
FIG. 1 is a side elevation showing an outboard motor mounted on the extra high transom of a boat (shown only in part)

Illustrated in FIG. 1 is marine propulsion device including an outboard motor 10 having an engine 12 shown in dotted lines. The engine 12 drives a propeller 14 through a drive shaft, gearing, etc., not shown. Combustion air passes through carburetors 16 at the front of the engine 12. The motor 10 is mounted for steering about a vertical axis 18 at the rear of brackets 20 which pivot about the horizontal axis of pivot pins 21 supported by brackets 22 fixed to the transom 24 of the boat 26. When the motor 10 is in the position shown in FIG. 1, the propeller 14 will be in the water and the bracket 20 rests against the stop 28. The motor 10 can be pivoted about the horizontal axis 21 to raise the propeller 14 out of the water. Provision for slight movement of the motor about axis 21 for trim purposes can be made.

High transom boats are frequently operated offshore where high sea conditions may be encountered. The boat transom 24 is quite high, leaving the motor 10 exposed to the sea. The engine 12 is protected against ingesting water by means of a cover assembly or shroud 25 which seals the engine 12 from rain and seawater and which includes a lower pan or cover 27 and an upper dome-like cover 29. The air for the engine 12 is drawn from inside the cockpit of the boat 26, that is, from the forward side of the transom 24, through an opening 30 through the transom 24. The opening 30 can, if desired, be hooded or otherwise protected against entry of water at that point.

The marine propulsion device includes duct means having opposite first and second ends, the first end communicating with the shroud 25 and the second end being adapted for connection to and through the transom 24 to enable the engine 12 to draw combustion air from the interior of the boat 26, the duct means including a flexible portion and a rigid portion. While various suitable means could be employed for this purpose, in the preferred embodiment, such means includes a flexible duct 32, a rigid conduit 34, a flexible duct 36, and a rigid duct or turret 38.

Figure 2:
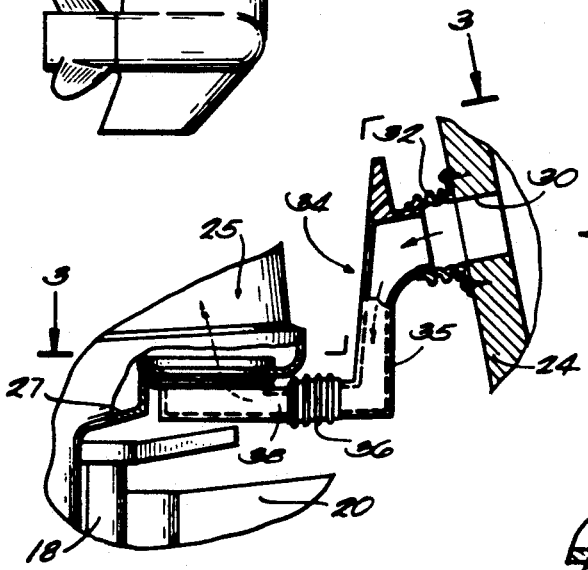
FIG. 2 is a partial vertical section of the pivotal air induction assembly for the motor illustrated in FIG. 1.

As best shown in FIG. 2, the short flexible duct 32 is connected between the opening 30 and the upper end of rigid conduit 34. The conduit 34 has an upper elbow connected to flexible duct 32, a generally vertical section 35, and a lower elbow leading aft to the flexible duct 36 which is connected to the forward end of the rigid duct or turret 38. The turret 38 communicates with a combustion air opening 42 in the shroud 25 and is rotatably connected to the shroud 25.

Figure 4:
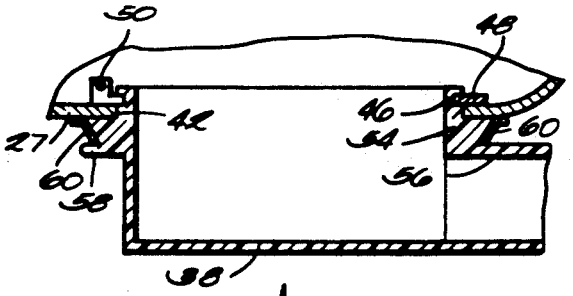
FIG. 4 is a detailed section showing the manner in which the rigid duct or turret is fixed to the lower cover.

As best shown in FIG. 4, the turret 38 has a duct portion 56 and a tubular portion projecting upwardly through the opening 42 in the lower cover 27 to position a groove 46 above the inside surface of the lower motor cover 27. The turret 38 includes means preventing axial movement of the tubular portion relative to the lower cover 27. While various suitable means could be employed for this purpose, in the illustrated construction, such means includes a snap ring 48 split at one place with adjacent upstanding bosses 50 apertured to receive a cotter pin 52 to keep the split ring closed, and an annular shoulder 54 engaging the outside of the lower cover 27 adjacent the opening 42. It will be noted that the shoulder 54 converges downwardly toward the turret duct portion 56. An annular seal 60 surrounds the shoulder 54 and engages the outside of the lower cover 27 for sealing the joint between the shoulder 54 and the lower cover 27 while permitting the turret 38 to rotate relative to the cover 27. Where there is no duct portion 56 a shoulder 58 is provided to confine the seal 60.

Figure 3:
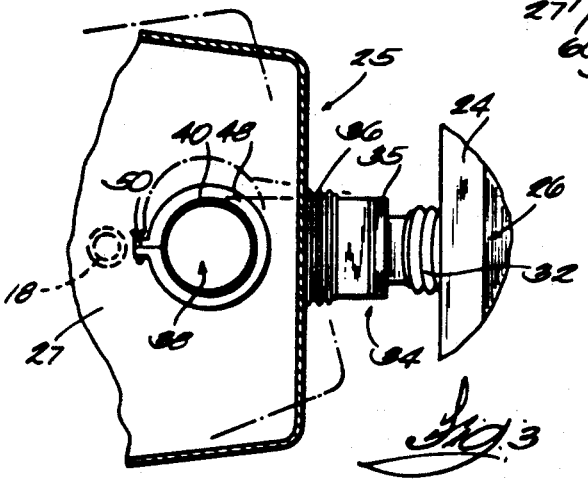
FIG. 3 is a meandering, generally horizontal section taken on line 3—3 in FIG. 2.

As may be seen in FIG. 3, as the motor turns, the turret 38 rotates relative to the cover 27. The flexible duct 36 will accommodate this turning movement and can elongate as well. Rotating the turret 38 minimizes the flexure required of the flexible duct 36.

The combustion air enters the air induction passage at 30 from the cockpit. The air passes down through the smooth interior of conduit 34 and enters the turret 38 where it is directed upwardly into the inside of the engine shroud 25. The chance of water entering the shroud 25 either with a wave breaking over the motor 10 or with momentary submerging of the transom 24 is minimized. Any water entering the shroud 25 will collect in the lower pan 27 and can be removed by any suitable pumping or draining means.

Illustrated in FIGS. 5 through 12 are several alternative embodiments of the invention. While each of these embodiments is shown in connection with a particular outboard motor mounting arrangement, it should be understood that each embodiment, as well as the embodiment shown in FIGS. 1 through 4, can be used in connection with other mounting arrangements. For example, the duct means shown in FIG. 6 can also be used with the engine well mounting arrangement shown in FIG. 5.

Figure 5:
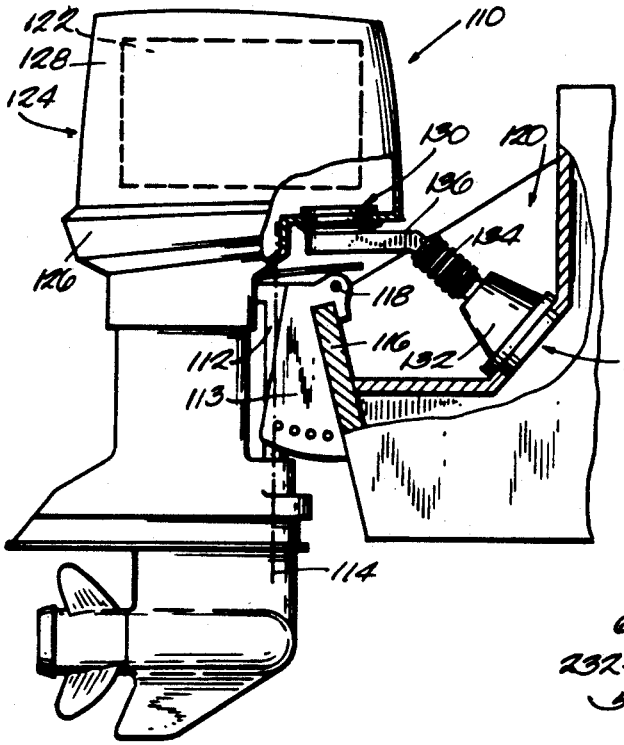
FIG. 5 is a side elevation view of an outboard motor mounted on the transom of a boat having an engine well, and of an alternative embodiment of the duct means for carrying combustion air to the engine.

Illustrated in FIG. 5 is one alternative embodiment of the invention. Shown is a marine propulsion device in the form of an outboard motor 110 similar to the motor shown in FIG. 1. The outboard motor 110 is mounted on a boat transom 116 by a conventional mounting bracket assembly. The outboard motor 110 is pivotally connected to a swivel bracket 112 for pivotal movement of the motor 110 relative to the swivel bracket 112 about a generally vertical steering axis 114. The swivel bracket 112 is connected to a transom bracket 113 mounted on the boat transom 116 for common pivotal movement of the motor 110 and of the swivel bracket 112 about a generally horizontal tilt axis 118, so that the motor 110 can be pivoted about the tilt axis 118 to raise the propeller out of the water. The boat has an engine well 120 which provides room for tilting of the outboard motor 110.

The outboard motor 110 includes an engine 122 substantially enclosed by a shroud 124 including a lower cover 126 and an upper dome-like cover 128. Air for the engine 122 is drawn from inside the cockpit of the boat through duct means connected between an opening 129 in the transom 116 and a combustion air opening 130 in the lower cover 126. The duct means includes an airbox 132 having one end connected to the opening 129 in the transom 116 and an opposite end connected to the lower end of a flexible duct or bellows 134. The upper end of the flexible duct 134 is connected to the forward end of a rigid duct or turret 136, which is connected to the combustion air opening 130.

The turret 136 has the same construction as the turret 38 illustrated in FIG. 4 and is similarly rotatably connected to the lower cover 126 for rotation about a generally vertical axis.

When the outboard motor 110 is turned, the turret 136 rotates relative to the lower cover 126. The flexible duct 134 elongates and twists in order to accommodate this movement of the turret 136. When the motor 110 is tilted, the turret 136 rotates forwardly and downwardly about the tilt axis 118, and the flexible duct 134 compresses and flexes to accommodate this movement.

Figure 7:
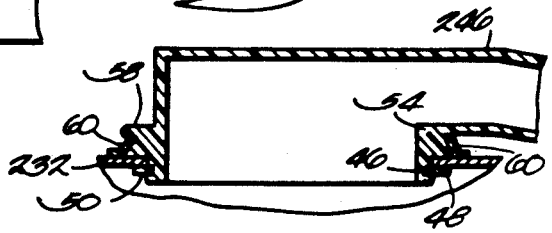
FIG. 7 is a detailed cross-sectional view of the manner in which the turret shown in FIG. 6 is connected to the upper cover.
Figure 6:
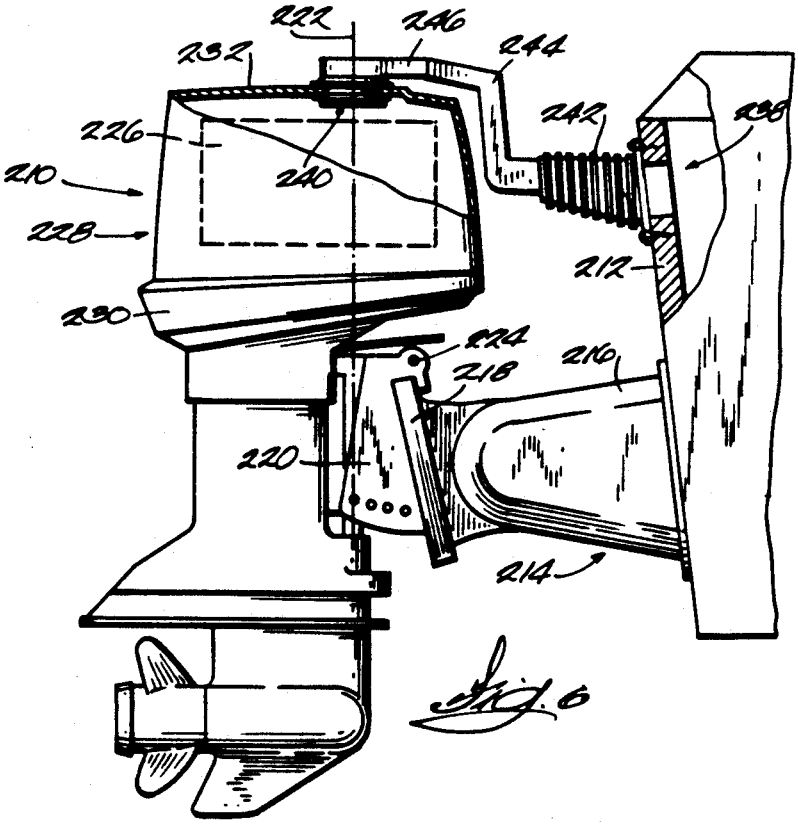
FIG. 6 is a side elevation view of an outboard motor mounted on an outrigger bracket assembly, and of another alternative embodiment of the duct means.

Illustrated in FIGS. 6 and 7 is another alternative embodiment of the invention. Shown is an outboard motor 210 mounted on a boat transom 212 with an outrigger bracket assembly 214. The outrigger bracket assembly 214 includes a rearwardly extending bracket 216 fixedly mounted on the boat transom 212 and supporting a false transom 218 that is substantially parallel to the boat transom 212. The outboard motor 210 is mounted on the false transom 218 by a mounting bracket assembly 220 similar to the mounting bracket assembly 112 shown in FIG. 5. The outboard motor 210 is pivotally connected to the mounting bracket assembly 220 for steering movement relative to the mounting bracket assembly 220 about a generally vertical steering axis 222, and for pivotal movement of the outboard motor 210 relative to the false transom 218 about a generally horizontal tilt axis 224.

The outboard motor 210 includes an engine 226 substantially enclosed by a shroud 228 including a lower cover 230 and an upper dome-like cover 232. Air for the engine 226 is drawn from inside the cockpit of the boat through duct means connected between an opening 238 in the transom and a combustion air opening 240 in the upper cover 232. The combustion air opening 240 is centered on the steering axis 222.

The duct means includes a flexible duct or bellows 242 having one end communicating with the opening 238 in the transom and sealingly connected to the transom 212 by any suitable means. The other end of the flexible duct 242 is connected to the forward end of an airbox 244. The rearward end of the airbox 244 is fixedly attached to a turret 246 communicating with the opening 240 in the upper cover 232 and rotatably connected to the upper cover 232 for rotation about the steering axis 222. The connection between the turret 246 and the upper cover 232 is best illustrated in FIG. 7 and is essentially the same as the connection shown in FIG. 4. Parts of the turret 246 shown in FIG. 7 corresponding to parts shown in FIG. 4 are given the same reference numeral.

Because the turret 246 is rotatably connected to the upper cover 232 for rotation relative to the upper cover 232 about the steering axis 222, the turret 246 and the remainder of the duct means do not move relative to the boat transom 212 during steering of the outboard motor 210. When the motor 210 is turned, the turret 246 remains stationary and the upper cover 232 rotates relative to the turret 246. The only movement of the duct means relative to the boat transom 212 is during tilting of the outboard motor 210. When the outboard motor 210 is tilted to raise the propeller, the turret 246 and airbox 244 rotate forwardly and downwardly relative to the tilt axis 224. This movement is accommodated by the flexible duct 242 communicating between the forward end of the airbox 244 and the boat transom 212.

Figure 9:
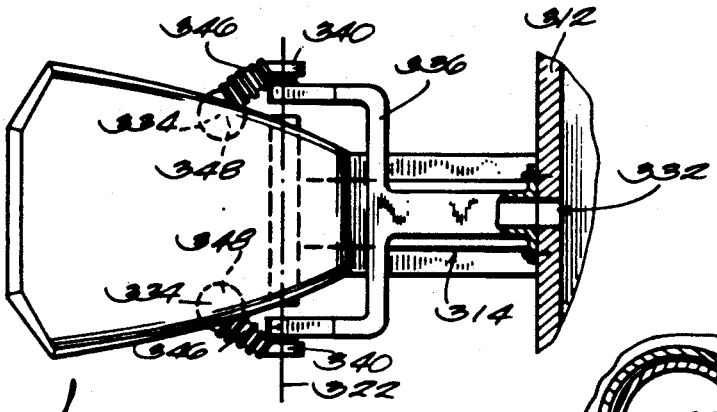
FIG. 9 is a top view, partially in cross section, of the outboard motor illustrated in FIG. 8.
Figure 10:
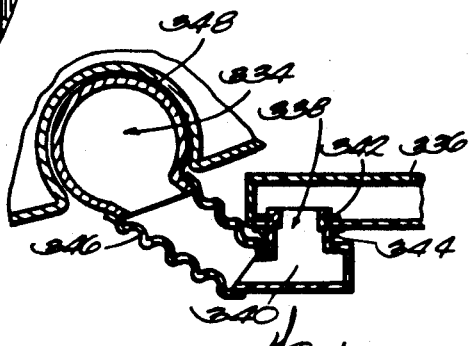
FIG. 10 is an enlarged cross-sectional view of a portion of FIG. 9.
Figure 8:
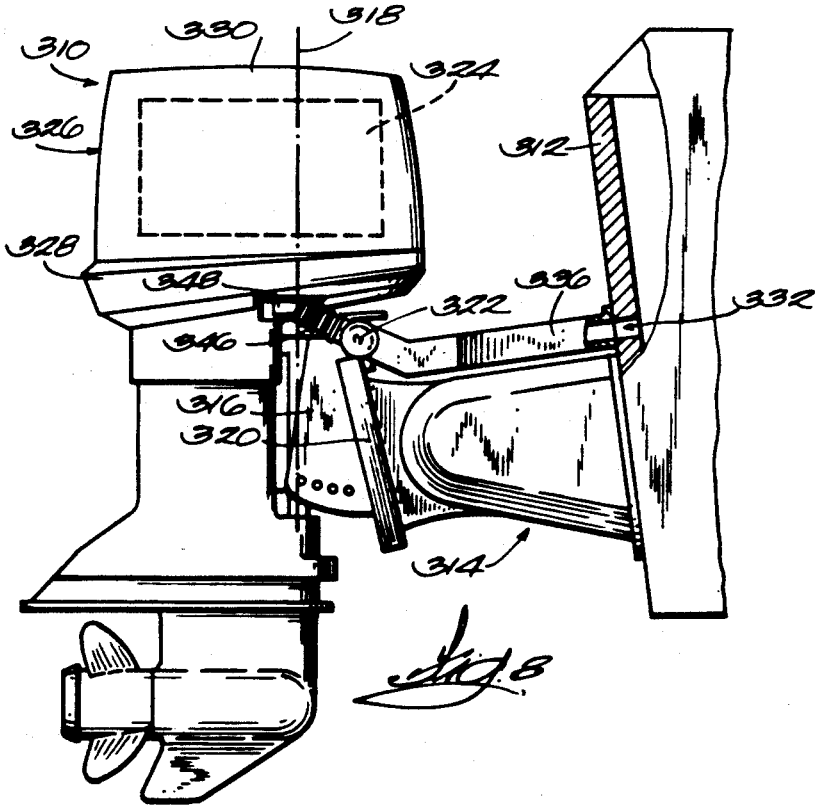
FIG. 8 is a side elevational view of an outboard motor mounted on an outrigger bracket assembly, and of another alternative embodiment of the duct means.

Illustrated in FIGS. 8 through 10 is another alternative embodiment of the invention. Shown in FIG. 8 is an outboard motor 310 mounted on a boat transom 312 with an outrigger bracket assembly 314 identical to the outrigger bracket assembly 214 illustrated in FIG. 6. The outboard motor 310 is pivotally connected to a mounting bracket assembly 316 for steering movement relative to the mounting bracket assembly 316 about a generally vertical steering axis 318, and for pivotal movement of the outboard motor 310 relative to the false transom 320 about a generally horizontal tilt axis 322.

The outboard motor 310 includes an engine 324 substantially enclosed by a shroud 326 including a lower cover 328 and an upper dome-like cover 330. Air for the engine 324 is drawn from inside the cockpit of the boat through duct means connected between an opening 332 in the transom 312 and a pair of combustion air openings 334 in the lower cover 328.

The duct means includes a generally Y-shaped airbox 336 having its base or forward portion communicating with the opening 332 in the transom 312 and sealingly connected to the transom 312. In the illustrated construction, the airbox 336 is connected to the transom 312 by screws, although any suitable connecting means can be used. The airbox 336 extends rearwardly of the boat transom 312 toward the outboard motor 310, and, at a point forward of the tilt axis 322, splits into two arms having outer ends that extend to points on the tilt axis 322 on either side of the outboard motor 310, as best shown in FIG. 9.

As best shown in FIG. 10, the outer end of each of the arms of the airbox 336 includes a circular aperture 338 centered on the tilt axis 322. In the illustrated construction, the aperture 338 faces outwardly, although it could also face inwardly. Communicating with each aperture 338 and rotatably connected to the outer end of the arm is a forward turret 340. The connection of the forward turrets 340 to the arms of the airbox 336 is similar to the connection of the turret 38 to the lower cover illustrated in FIG. 4. Each forward turret 340 has a tubular portion projecting inwardly through the aperture in the arm to position a groove inside the inside surface of the arm and is retained in this position by a snap ring 342 received in the groove. An annular seal 344 connected to the tubular portion of the forward turret 340 outside of the arm engages the outside surface of the arm. Because the aperture 338 in the arm is centered on the tilt axis 322, the forward turret 322 rotates relative to the arm about the tilt axis 322.

Each forward turret 340 is also connected to a flexible duct or bellows 346 having one end connected to the forward turret 340 and an opposite end connected to a rearward turret 348 communicating with one of the combustion air openings 334 in the lower cover 328 and connected to the lower cover 328 for rotation about a generally vertical axis. The connection of the rearward turret 348 to the lower cover 328 is similar to the connection illustrated in FIG. 4.

When the outboard motor 310 is steered from side to side, the rearward turrets 348 rotate relative to the lower cover 328 and the flexible ducts 346 flex in order to accommodate the movement about the steering axis 318 of the rearward turrets 348. When the outboard motor 340 is tilted about the tilt axis 322, the forward turrets 340 rotate relative to the arms of the airbox 336. During tilting there is no relative movement of the rearward turrets 348 or flexible ducts 346 with respect to the forward turrets 340.

Figure 12:
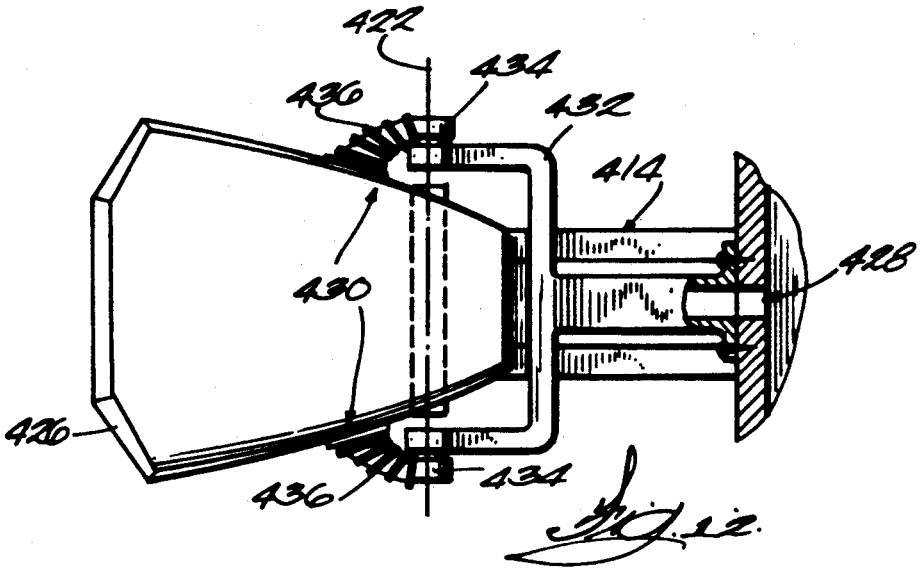
FIG. 12 is a top view, partially in cross section, of the outboard motor of FIG. 11.
Figure 11:
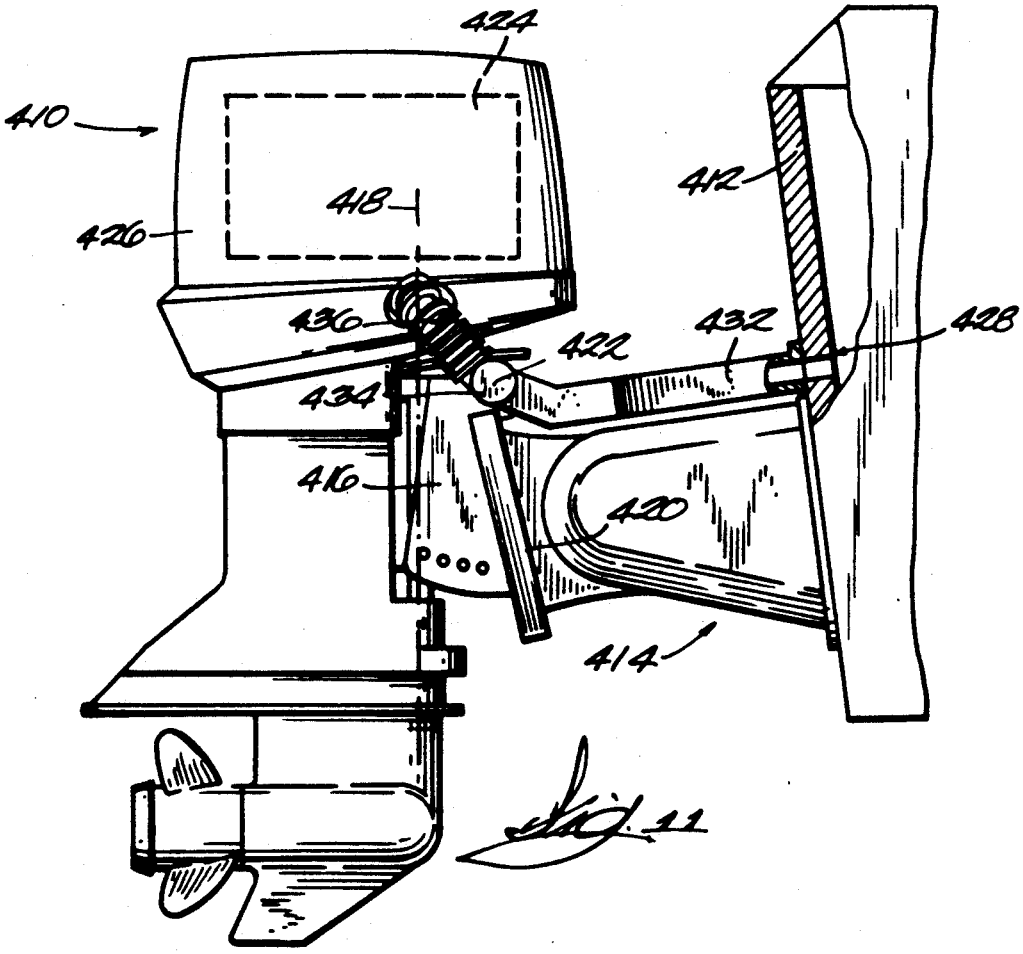
FIG. 11 is a side elevational view of an outboard motor mounted on an outrigger bracket assembly, and of another alternative embodiment of the duct means.

Illustrated in FIGS. 11 and 12 is another alternative embodiment of the invention. Shown in FIG. 11 is an outboard motor 410 mounted on a boat transom 412 with an outrigger bracket assembly 414 identical to the outrigger bracket assemblies illustrated in FIG. 6 and 8. The outboard motor 410 is pivotally connected to a mounting bracket assembly 416 for steering movement relative to the mounting assembly 416 about a generally vertical steering axis 418, and for pivotal movement of the outboard motor 410 relative to the false transom 420 about a generally horizontal tilt axis 422.

The outboard motor 410 includes an engine 424 substantially enclosed by a shroud 426. Air for the engine 424 is drawn from inside the cockpit of the boat through duct means connected between an opening 428 in the transom and a pair of combustion air openings 430 in the sides of the shroud 426.

The duct means illustrated in FIGS. 11 and 12 is very similar to the duct means illustrated in FIGS. 8-10. The duct means of FIGS. 11 and 12 includes a Y-shaped airbox 432 similar to the airbox 336 shown in FIGS. 8 and 9. The outer end of each of the arms of the airbox 432 includes a circular aperture centered on the tilt axis 422, and communicating with the aperture and rotatably connected to the outer end of each arm is a forward turret 434. The connection of the forward turrets 434 to the arms of the airbox 432 is identical to the connection of the forward turrets 340 to the arms of the airbox 336 illustrated in FIG. 10. Because the apertures in the arms of the airbox 432 are centered on the tilt axis 422, the forward turrets 434 rotate relative to the arms about the tilt axis 422.

Each forward turret 434 is also connected to a flexible duct or bellows 436 having one end connected to the forward turret 434 and an opposite end connected to the engine shroud 426 and communicating with one of the combustion air openings 430 in the sides of the shroud 426.

When the outboard motor 410 is steered from side to side, the flexible ducts 436 flex in order to accommodate the movement of the combustion air openings 430 about the steering axis 418. When the outboard motor 410 is tilted about the tilt axis 422, the forward turrets 434 rotate relative to the arms of the box 432. During tilting there is no relative movement of the flexible ducts 436 with respect to the forward turrets 434.

Various features of the invention are set forth in the following claims.

I claim:

1. A marine propulsion device comprising a mounting bracket, a propulsion unit including an internal combustion engine rotatably connected to said mounting bracket for rotation relative to said mounting bracket about a generally vertical steering axis, a shroud substantially enclosing said engine and including therein a combustion air opening generally co-axial with said steering axis, and duct means opening downwardly through said shroud into the interior thereof at said opening and being rotatably connected to said shroud for rotation about said steering axis, said duct means being adapted for connection to an opening in the transom of a boat to enable said engine to draw combustion air from the interior of the boat.

2. A marine propulsion device according to claim 1 wherein said duct means includes a rigid duct rotatably connected to said opening in said shroud, and a flexible duct having a first end connected to said rigid duct and a second end adapted to be connected to the opening in the transom.

3. A marine propulsion device according to claim 2 and further including means sealing the connection between said rigid duct and said shroud against entry of water.

4. A marine propulsion device according to claim 1 wherein said shroud has an inner surface, and wherein said duct means includes a rigid duct having a downwardly open tubular portion projecting through said opening in said shroud, said tubular portion having a groove disposed inside said shroud, and a retaining ring engaged in said groove and overlying said inner surface of said shroud to retain said rigid duct in said opening.

5. A marine propulsion device according to claim 4 wherein said shroud has an outer surface, and wherein said tubular portion includes a shoulder engaging said outer surface of said shroud opposite said retaining ring.

6. A marine propulsion device according to claim 5 and further including a seal engaging said shoulder and said shroud.

7. A marine propulsion device adapted to be mounted on a boat for pivotal movement relative thereto about a generally vertical steering axis, said marine propulsion device comprising a propulsion unit including an internal combustion engine, a shroud substantially enclosing said engine and including therein a combustion air opening generally co-axial with the steering axis, and duct means communicating with said opening and being supported relative to said shroud for relative pivotal movement between said duct means and said shroud about the steering axis, said duct means being adapted for connection to an opening in the boat to enable said engine to draw combustion air from the interior of the boat.

8. A marine propulsion device according to claim 7 wherein said duct means includes a rigid duct rotatably connected to said opening in said shroud, and a flexible duct having a first end connected to said rigid duct and a second end adapted to be connected to the opening in the boat.

9. A marine propulsion device according to claim 8 and further including means sealing the connection between said rigid duct and said shroud against entry of water.

* * * * *